US008837757B2

(12) United States Patent
Rung et al.

(10) Patent No.: US 8,837,757 B2
(45) Date of Patent: Sep. 16, 2014

(54) SYSTEM, METHOD AND HEARING AIDS FOR IN SITU OCCLUSION EFFECT MEASUREMENT

(75) Inventors: Martin Rung, Bronshoj (DK); Morten Agerbaek Nordahn, Bronshoj (DK)

(73) Assignee: Widex A/S, Lynge (DK)

( * ) Notice: Subject to any disclaimer, the term of this patent is extended or adjusted under 35 U.S.C. 154(b) by 395 days.

(21) Appl. No.: 13/183,567

(22) Filed: Jul. 15, 2011

(65) Prior Publication Data

US 2011/0299692 A1 Dec. 8, 2011

Related U.S. Application Data

(63) Continuation-in-part of application No. PCT/EP2009/050759, filed on Jan. 23, 2009.

(51) Int. Cl.
*H04R 25/00* (2006.01)

(52) U.S. Cl.
CPC ..... *H04R 25/70* (2013.01); *H04R 2430/03* (2013.01); *H04R 2460/05* (2013.01); *H04R 2400/01* (2013.01)
USPC ..... 381/312; 381/23.1; 381/60; 381/328

(58) Field of Classification Search
USPC ..... 381/328, 60, 312, 23.1
See application file for complete search history.

(56) References Cited

U.S. PATENT DOCUMENTS

| | | | | |
|---|---|---|---|---|
| 4,002,860 A * | 1/1977 | Terai et al. | ..... | 379/395 |
| 2003/0053646 A1 | 3/2003 | Nielsen et al. | | |

FOREIGN PATENT DOCUMENTS

| | | | | |
|---|---|---|---|---|
| JP | 2003-153372 A | | 5/2003 | |
| JP | 2008-517497 A | | 5/2008 | |
| WO | 2006/042540 A1 | | 4/2006 | |
| WO | 2008017326 A1 | | 2/2008 | |
| WO | WO 2008017326 | * | 2/2008 | ..... H04R 25/00 |

OTHER PUBLICATIONS

International Search Report for PCT/EP2009/050759 dated Nov. 11, 2009.

Office Action for JP2011-546620 dated Nov. 6, 2012, with English translation.

* cited by examiner

*Primary Examiner* — Davetta W Goins
*Assistant Examiner* — Amir Estesam
(74) *Attorney, Agent, or Firm* — Sughrue Mion, PLLC

(57) ABSTRACT

A hearing aid (1) adapted for operation in a sound amplification mode and for operation in an occlusion measurement mode, has a microphone (10) adapted for transforming an acoustic sound level external to a hearing aid users ear canal (4) into a first electrical signal which is guided to an A/D converter forming a first digitized electrical signal. The hearing aid has signal processing means with a filter bank (41, 42) with means for splitting an electrical signal into frequency bands, and a receiver (20) adapted for generating acoustic sounds in the ear canal of a user when in said amplification mode, and for transforming the acoustic sound level in the ear canal into a second electrical signal, when in occlusion measurement mode. The invention also provides a system and a method for measuring the occlusion effect.

10 Claims, 11 Drawing Sheets

Hearing Aid

SYSTEM, METHOD AND HEARING AIDS FOR IN SITU OCCLUSION EFFECT MEASUREMENT

RELATED APPLICATIONS

The present application is a continuation-in-part of application No. PCT/ EP2009050759, filed on Jan. 23, 2009, with the European Patent Office and published as WO2010/083888 A1.

BACKGROUND OF THE INVENTION

1. Field of the Invention

The present invention relates to hearing aids. The invention further relates to a system for measuring the occlusion effect by a hearing aid. The invention, still further, relates to a method for measuring the occlusion effect by a hearing aid in situ.

Occlusion Effect

When a hearing aid is placed in the ear of the user with an acoustically sealing ear mould it occludes the ear canal. This causes an elevation of the sound level of the user's own voice at the eardrum in the lower frequencies. For many hearing aid users their own voice then sounds hollow or boomy, and this is known as the Occlusion Effect (OE). The OE can be perceived so annoying to the user, that it becomes a major obstacle in the hearing aid use.

Blocking or occluding the ear canal with an ear mould has different effects on the sound from external sources and on the sound from the wearers own voice. Sound from external sources propagates as sound waves through the air to the ear. Occluding the ear canal attenuates the sound pressure generated at the eardrum (typically most at higher frequencies and less at lower frequencies).

Sound from the user's own voice propagates not only through the air from the mouth to the ear. For the lower frequencies the vibrations in the throat and the sound pressure in the vocal tract also propagate as vibrations in the bone and tissue to the wall of the ear canal. These vibrations in the wall do produce a sound pressure at the eardrum as well. However, in the open (not occluded) ear, the air can easily flow in and out of the ear canal, and the sound pressure resulting from the vibration is generally low and hardly significant compared to the sound propagating through the air.

In the occluded ear the air is trapped in the small volume of the ear canal, and so the vibration in the wall results in a much higher sound pressure, often significantly higher than the sound pressure would have been in an open ear at lower frequencies. At the same time the sound propagating through the air is attenuated (mainly at high frequencies) by the ear mould. These effects may cause the user's own voice to be perceived as sounding hollow and boomy.

The Occlusion Effect (OE) is generally a function of the frequency, but also of what sounds are spoken (articulated). Several other factors impact the OE as well.

The acoustic sealing of the ear mould has a strong effect. Introducing a leakage or vent in the ear mould generally decreases the OE. This is the most common way for reducing the annoyance, but it has also undesired consequences (jeopardizing stability or amplification of the hearing aid). A vent is often provided in the form of a tube or canal extending through the ear mould or hearing aid housing, facilitating transmission of acoustic waves from one side to the other so that the ear canal is not completely blocked. The vent allows bone conducted sound to escape from the inner portion of the ear canal. The energy loss and the risk of acoustic feedback increase with increasing vent diameter when the vent length is the same. However, prevention of the occlusion effect imposes the requirement of a large vent diameter. On this background it is often relevant to measure the occlusion effect when fitting a specific ear mould or hearing aid housing to a hearing aid user. Knowledge of the specific occlusion effect can be used for adjusting the vent diameter to an optimum dimension when considering occlusion, energy loss and feedback in relation to the individual hearing aid user.

The insertion depth of the ear mould also has an impact on the occlusion effect. It is mostly vibrations in the soft tissue forming the first part (from the entrance) of the canal that causes the OE. So a deeper insertion of the ear mould blocks more of the vibrating wall resulting in decreased OE.

Furthermore, the OE is impacted by individual anatomy which influences both the volume of the ear canal as well as the level of the vibration.

These factors make it difficult to predict and assess the OE just by inspection. A measurement of OE is usually required.

Whether a particular OE is perceived annoying or not does not only depend on the magnitude of the OE. Also the actual hearing loss and insertion gain of the hearing aid as well as personal tolerance may impact the perception and possible annoyance. Yet, it is important to assess the occlusion effect in the process of analyzing how a hearing aid user perceives his/hers own voice.

In Situ Occlusion Effect Measurement

The Occlusion Effect is a time variant transfer function. The OE of a speaker's own voice is a transfer function between the sound pressures generated at the eardrum by the voice when the ear canal is occluded ear and the sound pressures generated at the eardrum by the voice when the ear canal is open.

$$OE = \frac{p_{drum,occluded}}{p_{drum,open}}$$

This implies a transfer function between two signals which do not exist simultaneously. Furthermore the transfer function does not only depend on properties of these two configurations, but also on the actual source (the voice signal, i.e. what is being articulated).

As it may be difficult to repeat a voice signal accurately enough for a proper serial measurement, the OE may be estimated from other transfer functions based on signals that do exist simultaneously.

The OE can be expanded into the following three factor product (each factor being a transfer function):

$$OE = \frac{p_{drum,occluded}}{p_{drum,open}} = \frac{p_{drum,occluded}}{p_{ext,occluded}} \cdot \frac{p_{ext,occluded}}{p_{ext,open}} \cdot \frac{p_{ext,open}}{p_{drum,open}}$$

$p_{ext,occluded}$ and $p_{ext,open}$ are the sound pressures at a point outside the ear canal or outside the ear with the canal occluded by the ear mould, or with the canal open, respectively. The position may e.g. be at the side of the head above the pinna, where a Behind-The-Ear (BTE) hearing aid is typically placed.

If the two latter factors (i.e. $p_{ext,occluded}/p_{ext,open}$) and ($p_{ext,open}/p_{drum,open}$)) are known and time invariant, a measurement of OE can be performed by measuring the first factor (transfer function) and then multiplying with the two other factors.

If $p_{ext,occluded}$ and $p_{ext,open}$ are captured (i.e. measured by transforming an acoustical signal into an electrical signal) by a microphone, e.g. the microphone of a BTE hearing aid, and $p_{drum,open}$ is captured by a probe microphone, both factors can be determined and examined. For the lower frequency range in which the OE is of most importance both factors are close to 1, both factors show only little dependence of the speech signal and both factors show only little individual variation. So these two factors can be well approximated by constants. For the frequency range of interest this may also be generalized to apply to microphone positions of other types of hearing aids, e.g. In-The-Ear (ITE) or Completely-In-Canal (CIC) hearing aids.

So, the remaining task is to measure ($p_{drum,occluded}$/$p_{ext,occluded}$) for the actual individual in order to quantify the occlusion effect.

It is advantageous to be able to apply the hearing aid for the occlusion effect measurement. Such in situ occlusion measurement by application of the hearing aid gives a simple and fast measurement with minimum requirements for equipment to be applied in connection with the fitting of the hearing aid.

Depending on the purpose of the measurement different speech signals from the speaker may be used. Possible speech signals may be running speech as well as sustained articulation of specific vowels.

A convenient way of measuring this is by capturing $p_{ext,occluded}$ by the hearing aid microphone and capturing $p_{drum,occluded}$ by the hearing aid receiver.

2. The Prior Art

WO-A1-2008/017326 describes occlusion effect measurement by using the hearing aid, relying on the users own voice as a sound source. WO-A1-2008/017326 also discloses using the receiver (i.e. a loudspeaker) as the transducer measuring the sound pressure in the ear canal of the occluded ear. Thereby, the need for an extra microphone in the ear mould or hearing aid housing is avoided. The standard microphone is used for measuring the sound pressure outside the ear.

WO-A1-2008/017326 does, however, not disclose any information on how to use the receiver as the transducer. The receiver when used as transducer for measuring the sound pressure will give a very different response compared to a standard microphone used in a hearing aid. This is a problem since the two microphones needed for measuring the occlusion effect in situ should give the same response for the same sound pressure. Furthermore, the sensitivity of the receiver when used as microphone is considerably lower compared to a standard microphone.

SUMMARY OF THE INVENTION

It is a feature of the present invention to provide a solution using the receiver as a transducer measuring the sound pressure $p_{drum,occluded}$, which solution can be implemented in practice in a hearing aid solving the above problems.

The invention, in a first aspect, provides a system for measuring the occlusion effect comprising a hearing aid adapted for operation in a sound amplification mode and for operation in an occlusion measurement mode, said hearing aid comprising a microphone adapted for transforming an acoustic sound level external to a hearing aid user's ear canal into a first electrical signal, said first electrical signal being guided to an A/D converter forming a first digitized electrical signal, a receiver adapted for generating acoustic sounds in the ear canal of a user when in said amplification mode, and adapted for, when in said occlusion measurement mode, transforming the acoustic sound level in the ear canal into a second electrical signal, and directing the second electrical signal to an A/D converter forming a second digitized electrical signal, said system comprising a signal processing means comprising a filter bank with means for splitting an electrical signal into different frequency bands, wherein said system is adapted for, when in occlusion measurement mode, applying said filter bank for splitting the first and the second digitized electrical signals into respective first and second band split digitized electrical signals, and wherein said hearing aid comprises means for transmitting simultaneous samples of the first and the second band split digitized electrical signals to calculating means, said calculating means comprising a detector bank for measuring the level of the signal in each frequency band, and means for calculating the occlusion effect based on a ratio between simultaneous samples of the first and the second band split digital electric signals.

The hearing aid according to the invention has the advantage of applying the filterbank of the hearing aid also for the second electrical signal. Thereby the invention provides a simple construction for measuring the occlusion effect in situ with the hearing aid arranged at the hearing aid user's ear, relying on the hearing aid users own voice as sound source. The electrical signals can easily be transferred to a computer for the processing not already performed in the hearing aid.

In a preferred embodiment of the system according to the invention the signal processing means including the filter bank is part of the hearing aid. In this preferred embodiment the normal signal processing means and filter bank in the hearing aid is applied for splitting the signals into bands. This embodiment will reduce the requirements for the part of the system external to the hearing aid, and may facilitate a simpler in situ occlusion measurement.

In a preferred embodiment of the system according to the invention the filter bank comprises bandpass filters for dividing the electrical signal into bandpass filtered electrical signals. This offers a fast well defined band splitting of the signal.

In a preferred embodiment the hearing aid comprises switching means for switching the coupling of the receiver between sound amplification mode and occlusion measurement mode. This facilitates easy and reliable switching of the hearing aid between occlusion measurement mode and amplification mode. Such a switch may couple the receiver to an A/D converter, e.g. one of the two otherwise used for one of the two input microphones. I.e. the electronic circuit must comprise at least two A/D converters.

In a preferred embodiment the second electrical signal is equalized in order to compensate the frequency dependent transfer function of the hearing aid receiver when used as microphone. The electrical signal from the receiver is directed to an ND converter forming a digitized signal. This signal is equalized in order to compensate the specific transfer function of the receiver. The equalization is weighing the signal as function of frequency. Such equalization will make it possible to compare the electrical signal from the receiver used as microphone with the electrical signal from the microphone.

This will be an advantage since the frequency response of the receiver, when used as microphone, is not directly comparable to that of a microphone. Often the specific frequency dependent transfer function of the receiver used as microphone has been characterized in a prior calibration.

This transfer function may then be applied for modifying/equalizing the signal from the receiver before the filter bank in order to make the band signals after the filter bank comparable with the corresponding signals of the microphone. This modification could be performed by the use of a filter.

In a further embodiment of the system according to the invention the calculating means are arranged within the hearing aid. This calculating is used for finding the occlusion effect from the signal obtained from the receiver used as microphone and from the signal from the microphone.

In a further embodiment the calculating means also comprises means for detecting and discarding invalid data. Invalid data could arise if the sound source is not as presumed. If the hearing aid users own voice is selected as sound source the relative magnitude of the two signals will show if another sound source has been dominating in a given sample.

In a further embodiment of the system according to the invention the calculating means comprises ratio calculation means, the task of which is to calculate the ratio between the first and the second band split digitized electrical signals, i.e. the signal from the receiver used as microphone, and the signal from the microphone, in order for calculating the occlusion effect from simultaneous samples.

The invention, in a second aspect, provides a method for measuring the occlusion effect comprising the steps of arranging a hearing aid at a hearing aid user's ear with the earmould or the hearing aid housing fitting tightly in the ear canal, operating the hearing aid in an occlusion measurement mode, transforming an acoustic sound external to a hearing aid user's ear into a first electrical signal by application of a microphone in the hearing aid, transforming an acoustic sound level in the hearing aid user's ear canal into a second electrical signal by application of the receiver in the hearing aid, converting said first and second electrical signals into first and second digitized electrical signals, splitting the first and the second digitized electrical signals into respective first and a second band split digitized electrical signals, transmitting simultaneous samples of the first and the second band split digitized electrical signals to calculating means, measuring the level of the signal in each frequency band by a detector bank, and calculating the occlusion effect based on a ratio between simultaneous samples of the first and the second band split digital electric signals.

In a further embodiment of the method according to the invention the hearing aid users own voice is applied as sound source during the measuring of the occlusion effect. Preferably, said first and second electrical signals are applied for determining if the hearing aid users own voice is the sound source at a specific time.

In a further embodiment of the method according to the invention said second digitized electrical signal is being equalized in order to compensate the specific transfer function of a receiver used as microphone.

The invention, in a third aspect, provides a hearing aid adapted for operation in a sound amplification mode and for operation in an occlusion measurement mode, said hearing aid comprising a microphone adapted for transforming an acoustic sound level external to a hearing aid user's ear canal into a first electrical signal, said first electrical signal is guided to an ND converter forming a first digitized electrical signal, a receiver adapted for generating acoustic sounds in the ear canal of a user when in said amplification mode, and adapted for, when in said occlusion measurement mode, transforming the acoustic sound level in the ear canal into a second electrical signal, and directing the second electrical signal to an A/D converter forming a second digitized electrical signal, and signal processing means comprising a filter bank with means for splitting an electrical signal into different frequency bands, wherein said signal processing means is adapted for, when in said occlusion measurement mode, applying said filter bank for splitting the first and the second digitized electrical signals into respective first and second band split digitized electrical signals, and wherein said hearing aid comprises means for transmitting simultaneous samples of the first and the second band split digitized electrical signals to calculating means, said calculating means comprising a detector bank for measuring the level of the signal in each frequency band, and means for calculating the occlusion effect based on a ratio between simultaneous samples of the first and the second band split digital electric signals.

In practice the signal from the receiver used as microphone can be read at different points in the circuit and sent to an external computer for further processing.

In a behind-the-ear (BTE) hearing aid the receiver is arranged in the hearing aid shell, and the acoustic connection to the ear canal is through a tube and an earplug. The application of the tube will add the resonance frequencies of the tube to the response of the receiver. Preferably, this should be taken into account in the modification or equalization of the signal from the receiver used as microphone.

BRIEF DESCRIPTION OF THE DRAWINGS

Embodiments of the invention will now be described in detail with reference to the figures.

DETAILED DESCRIPTION

Figure 1:
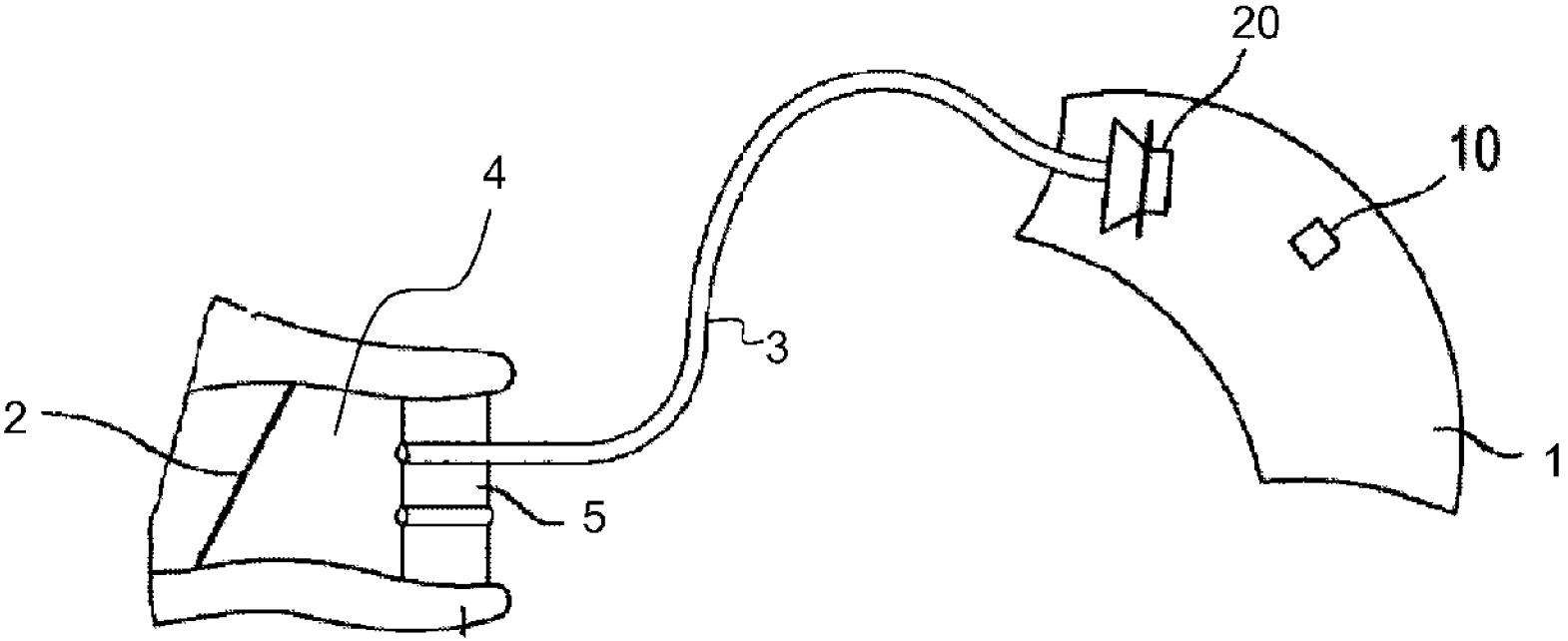
FIG. 1 illustrates a behind-the-ear hearing aid with the receiver connected to the volume of the ear canal between the ear mould and the ear drum.

From FIG. 1 it is seen how a receiver 20 of a behind-the-ear hearing aid 1, connected to the inner part of the ear canal through a tube 3 passing an ear mould 5, could be applied both for generating acoustic sounds when the hearing aid is operated in a sound amplification mode and for transforming the acoustic sound level in front of the ear drum 2 in the ear canal 4 into an electrical signal when the hearing aid is operated in an occlusion measurement mode. In both modes a standard microphone 10 is applied for recording sounds external to the ear canal 4.

Figure 2:
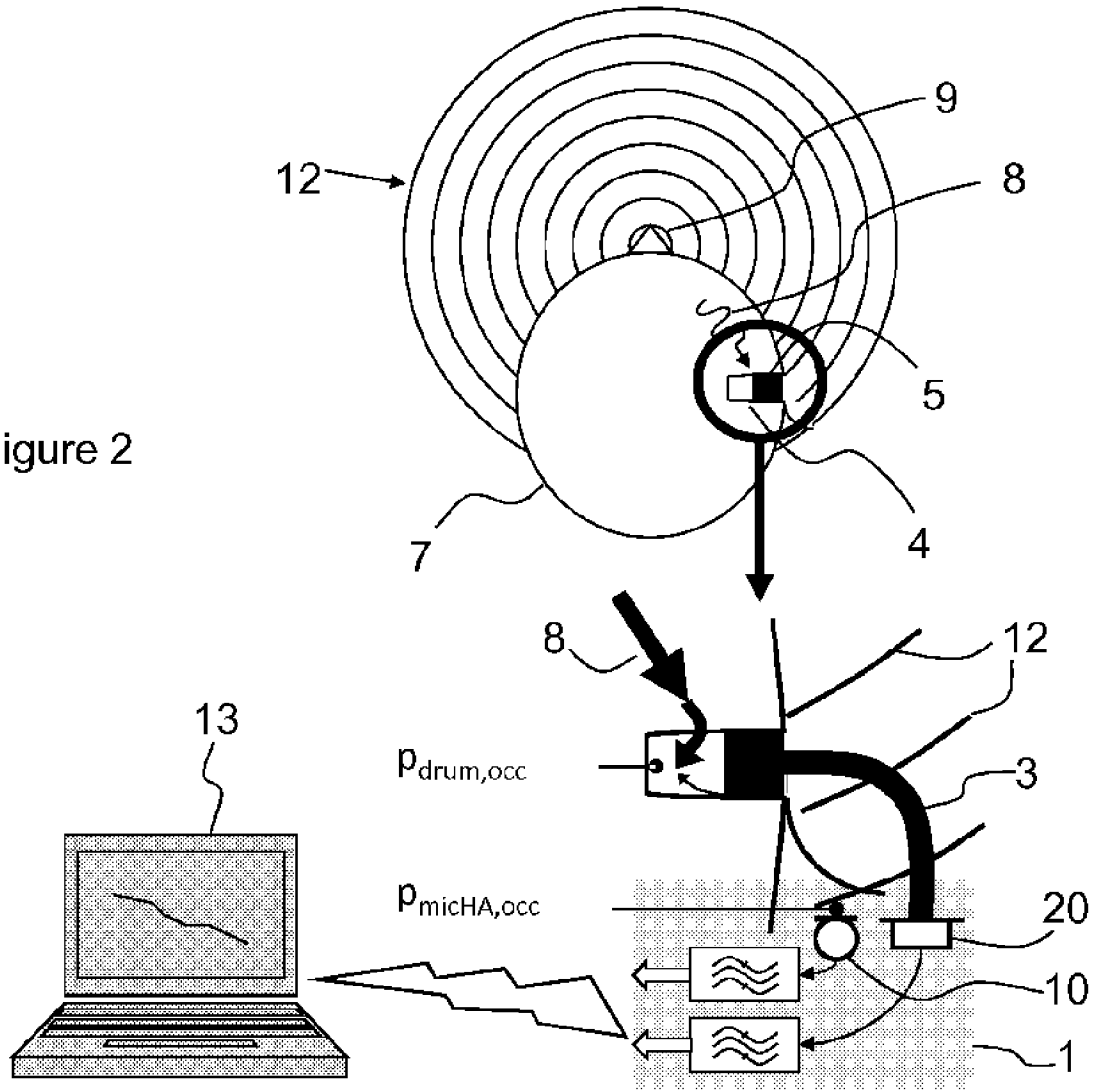
FIG. 2 illustrates the principle of passage of bone conducted as well as air conducted sound waves from mouth to ear drum as well as the principle of occlusion effect measurement.

FIG. 2 shows the basic principles of the occlusion effect. For simplicity the head 7 of the hearing aid user is illustrated as a circle with the mouth 9 and one ear canal 4. Air conducted sound waves illustrated as concentric circles 12 propagate from the mouth 9 of the hearing aid user when speaking, but only reach the ear canal 4 to a limited extent due to the ear mould 5. The bone conducted speech 8 travelling as vibrations in the head tissue will, however, not be limited by a typical ear mould 5, or hearing aid housing. The ear mold 5 will on the other hand block sound from leaving the ear canal 4, thereby increasing the level of sound reaching the ear drum 2 from the bone conducted speech compared to the situation without ear mould 5 or hearing aid housing arranged in the ear canal 4.

The receiver 20 is connected to the occluded cavity in front of the ear drum 2 through the sound canal 3 of the hearing aid 1, and the typical balanced armature receiver 20 used in hearing aids, may operate as a microphone as well. I.e. the receiver 20 will when exposed to a sound pressure produce an electrical voltage across its electrical terminals. If the receiver is disconnected from the amplifier usually driving it and instead connected to a microphone input of the hearing aid, the receiver can be used as a microphone in a similar way as the normal microphone 10 of the hearing aid. When the hearing aid 1 is in the occlusion measurement mode, both the signal from the receiver 20 and from the microphone 10 are guided to the filter bank 41, 42 (see FIG. 4) in the hearing aid. The signals transferred to an external computer 13 (see FIG. 2) will depend on the setup of the hearing aid 1 when in the occlusion measurement mode.

Figure 3:
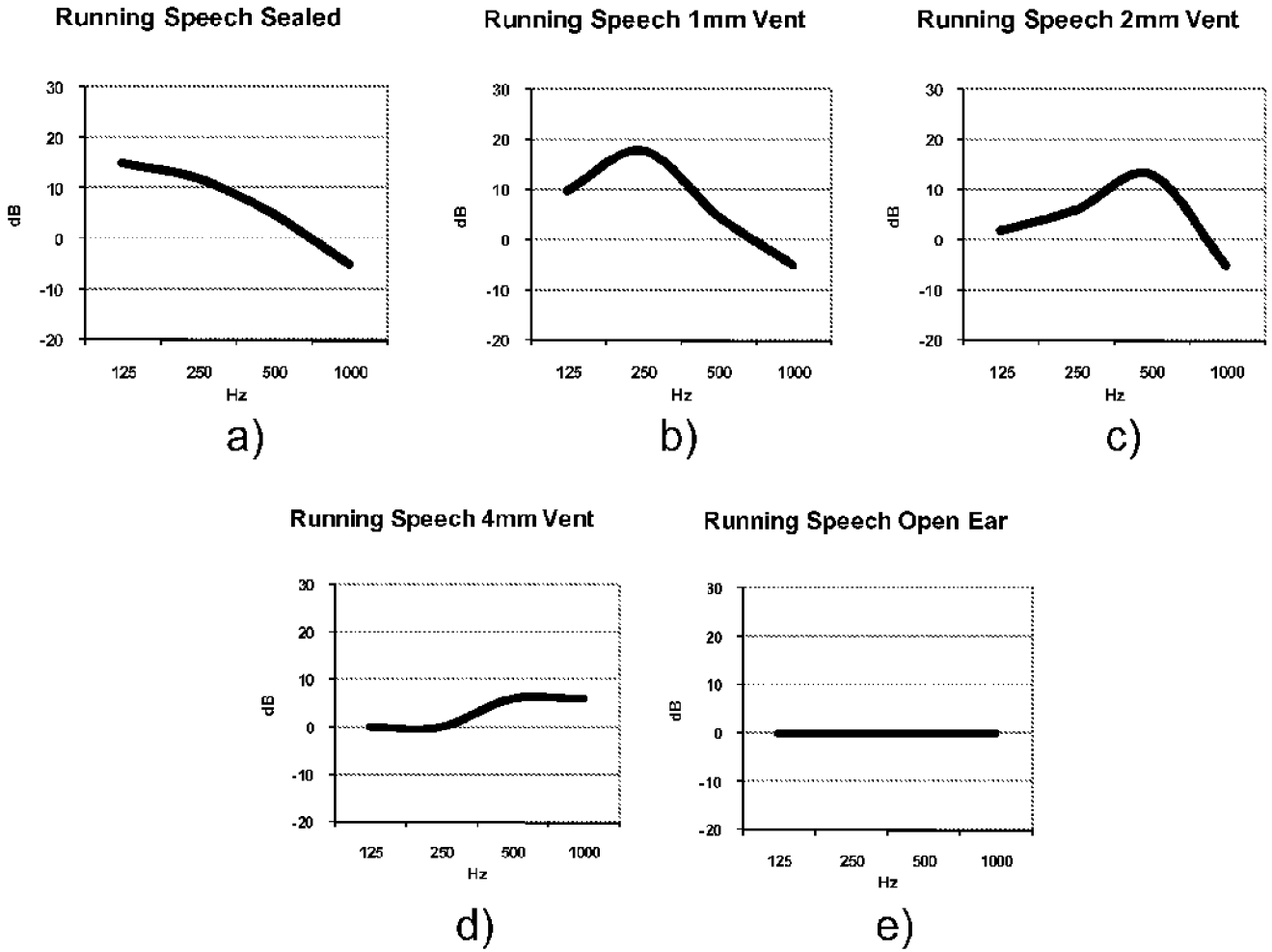
FIG. 3 illustrates how the occlusion effect, in dependency on sound frequency, will vary with vent size, the figure comprising panes a-e.

FIG. 3, in panes a-e, shows the average occlusion effect as function of frequency for ordinary speech. The occlusion effect is an amplification of specific frequencies. The occlusion effect may be up to 20 dB or more. If the occlusion effect is below 5 dB the hearing aid user will usually not be bothered. In FIG. 3, pane a, the occlusion effect is shown for a sealed ear mould. The ear mould may be the hearing aid itself such as in the case of an In-The-Ear (or similar type) of hearing aid. In FIG. 3, pane b, the occlusion effect is shown when the ear mould is provided with a vent, i.e. a ventilation channel, having a diameter of 1 mm. FIG. 3, panes c and d, shows the occlusion effect when the vent diameter is 2 or 4 mm, respectively. FIG. 3, pane e, shows that for the open ear there is no occlusion effect. In general, a larger vent will result in a lower occlusion effect. As seen from FIG. 3, panes a and b, the occlusion effect is largest for the lower frequencies.

Figure 4:
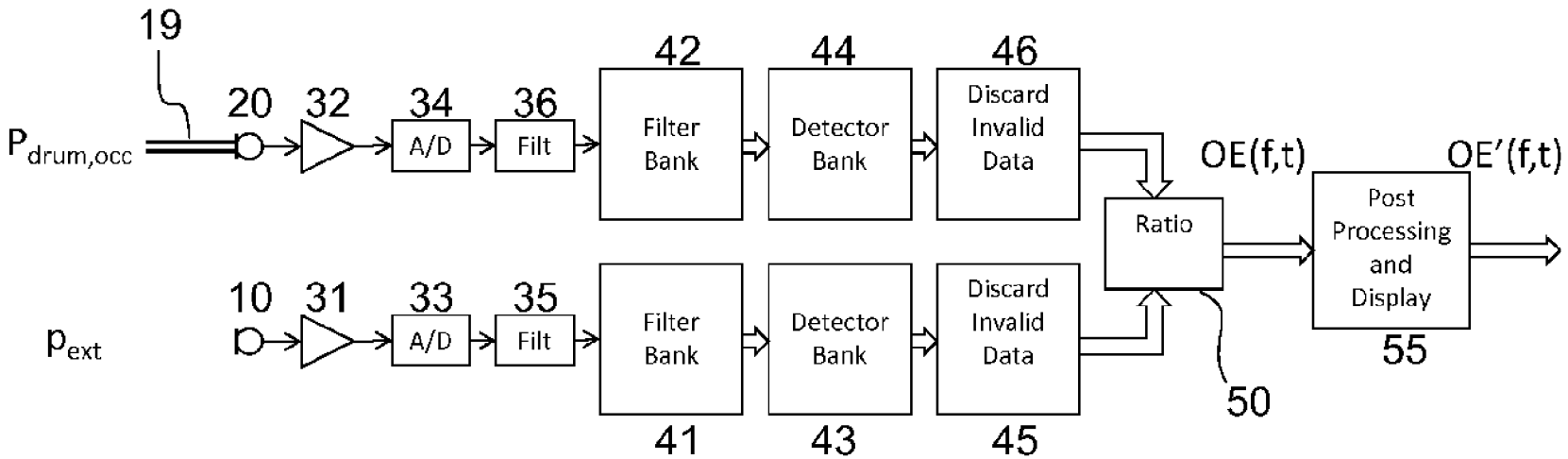
FIG. 4 illustrates one embodiment of the invention.

FIG. 4 shows a general implementation of a system for carrying out the method according to the invention. All or part of the system may be integrated in the hearing aid 1. Two sound pressure sensing transducers 10, 20 are shown, one being a microphone 10 and one being a receiver 20. The receiver may be connected to the volume in front of the ear drum 2 through a sound tube 3, 19. The sound pressure external to the ear of the hearing aid user is denoted $p_{ext}$ and may be sensed by a usual microphone 10 of the hearing aid 1. When the hearing aid comprises two microphones 10, 11 (see FIG. 7), for the purpose of obtaining a specific directional sensitivity, any of the microphones 10, 11 may be applied for measuring the sound pressure external to the ear. At least one microphone 10, 11, a receiver 20, preamplifiers 31, 32, A/D converters 33, 34, filters 35, 36, and filter bank 41, 42 are part of the hearing aid in embodiments of the invention including these components.

A spectral analysis can be done by the hearing aid filter bank 41, 42, and the signal levels in each band can be observed in terms of sampling the level detectors (detecting rms values or other measures related to the level and other statistical properties of the signals). These values may be further processed in the hearing aid or may be exported to a PC for further analysis, calculation of the ratio (transfer function), correction and presentation.

This approach to measuring ($p_{drum,occluded}/p_{ext,occluded}$) is not straight forward. $p_{ext,occluded}$ may be captured in good quality and without major problems by the hearing aid microphone 10. However, two major challenges originate from using the receiver as a microphone to capture $p_{drum,occluded}$:

One challenge is that the acoustic sensitivity of the transducer, here the receiver used as microphone, is very low leading to a severely high equivalent input noise due to the noise floor of the input circuits.

Another challenge is that the acoustic sensitivity of the transducer, i.e. the receiver used as microphone, is very dependent on frequency. At lower frequencies it typically slopes by 6 dB/octave and furthermore resonance peaks occur at higher frequencies due to transducer resonances and the resonances of the sound canal attached to the transducer.

Other challenges originate from using the hearing aid filter bank 41,42 and the level detectors. A filter bank often comprises a number of band pass filters splitting the input signal into bands. The selectivity of hearing aid filter banks is not necessarily optimized for measurement purposes, but typically represents a balanced compromise with other properties of the filters. So these band pass filters will generally have a limited selectivity.

Applying the human voice as sound source for the occlusion effect measurement introduces the challenge that the spectrum of speech will typically have the signal energy concentrated in a smaller number of pure tones or narrow bands. A narrow band signal will have the major part of its energy concentrated in one or two bands of the filter bank. However, due to the limited selectivity a narrow band signal will be detected not only in the closest band(s), but will also be detected in adjacent bands. This is denoted spectral leakage.

Calculating the transfer function for a band mostly containing spectral leakage from a narrow band signal located outside the pass band may lead to a wrong value for the band. So bands containing only (or mainly) leakage must be identified and discarded.

The two signals used to calculate the transfer function are captured by two different transducers. If the transducers do not have similar frequency responses the effects of spectral leakage becomes much more critical. This is the case when using a normal microphone 10,11 for capturing $p_{ext,occluded}$ and the receiver for capturing $p_{drum,occluded}$, unless the signals are equalized to give both transducers the same frequency response. This may be done by applying an equalization filter to the signal from the receiver. The equalization filter shall, in the frequency range of interest for the measurement, have a frequency response which is (or approximates) the reciprocal of that of the transducer.

Only observed values of $p_{ext,occluded}$ and $p_{drum,occluded}$ which are not dominated by leakage or noise are valid for calculation of the OE. Observations dominated by leakage or noise should be discarded, such that the OE is only calculated when data is valid.

In the following the impact of leakage and additive noise as well as a non-flat frequency response of the transducers will be addressed.

The two sound pressures, $p_{drum,occluded}$ and $p_{ext,occluded}$, needed for calculating the OE are observed in terms of detected levels of the filter banks applied to the two signals.

In general the situation is equivalent for each one of the sound pressure signals and the one filter bank. The filter bank consists of N adjacent band pass filters. Each band is considered to extract the part of the signal which has a frequency content located in that particular band. The j'th filter has a pass band from $f_j$ to $f_{j+1}$, and so $f_j$ is the cross over frequency between band (j−1) and band j, and $f_{j+1}$ is the cross over frequency between band j and band (j+1). However, band pass filters have only a limited selectivity. The frequency response of the band pass filter for band j, is not zero outside the pass band. For frequencies in the pass band of band k, the frequency response is $F_{j,k}$:

So if j=k then $F_{j,k}$ is assumed to be 1 (or close to 1). Otherwise (i.e. for j< >k) $1>F_{j,k}>0$.

Assume that the transducer capturing the sound pressure has sensitivity, $T_j$, to the sound pressure in band j.

Assume that the power of the desired sound pressure signal, Ps, originating from the speakers voice is the sum of N contributions where the j'th contribution, $Ps_j$, is the power of the signal that has it's frequency content in the pass band of band j.

Assume that there may be an undesired noise added to the desired sound pressure. The noise has the power, Pn, which is the sum of N contributions where the j'th contribution, $Pn_j$, is the power of the noise that has it's frequency content in the pass band of band j.

The desired signal is independent of, and therefore, uncorrelated with the noise. So the power of the signal and the noise in band j becomes ($Ps_j$+$Pn_j$).

So the power of the output of filter j, $X_j$, becomes:

$$X_j = \sum_{k=1}^{N} F_{j,k}^2 T_k^2 (Ps_k + Pn_k)$$

This may be re-written to:

$$X_j = \sum_{k=1}^{N} F_{j,k}^2 T_k^2 Ps_k + \sum_{k=1}^{N} F_{j,k}^2 T_k^2 Pn_k$$

And further to:

$$X_j = F_{j,j}^2 T_j^2 Ps_j + \sum_{k=1}^{(j-1)} F_{j,k}^2 T_k^2 Ps_k + \sum_{k=(j+1)}^{N} F_{j,k}^2 T_k^2 Ps_k + \sum_{k=1}^{N} F_{j,k}^2 T_k^2 Pn_k$$

So the observed power in the output of filter j does not only depend on the power of the desired sound pressure in band j. There are both contributions from the undesired noise as well as contributions from the desired signal in other bands leaking in to band j, due to limited selectivity of the band pass filter.

In some cases the first term (that is only dependent of $Ps_j$) dominates so that the three last terms may be neglected.

$$X_j \approx F_{j,j}^2 T_j^2 Ps_j$$

Then the desired sound pressure signal in band j, $s_j$, can be estimated by:

$$\mathrm{Est}(s_j) = T_j^{-1}\sqrt{X_j}$$

For the calculation of OE in band j, $OE_j$, both the sound pressures, $p_{drum,occluded}$ and $p_{ext,occluded}$, for that particular band are needed. Only if both sound pressures can be estimated the OE can be calculated.

In some cases $X_j$ may be corrected for the influence of spectral leakage or noise, but this will not be possible in all cases.

So it is important for the accuracy of the OE results to minimize the influence of leakage and noise.

The contribution from spectral leakage, $L_j$, is:

$$L_j = \sum_{k=1}^{(j-1)} F_{j,k}^2 T_k^2 Ps_k + \sum_{k=(j+1)}^{N} F_{j,k}^2 T_k^2 Ps_k$$

And the contribution from noise, $N_j$, is:

$$N_j = \sum_{k=1}^{N} F_{j,k}^2 T_k^2 Pn_k$$

From knowledge about the frequency response of the transducer, $T_j$, the frequency response of the filter bank band pass filters, $F_{j,k}$, and the noise level with sound pressure present, $Pn_k$, the contributions from spectral leakage and noise can be estimated.

By comparing the observed $X_j$ with such estimates, it can be determined whether an observation should be regarded valid for calculation of the OE.

Steps may be taken to minimize the impact from spectral leakage.

Normally the band pass filters of a filter bank are designed as selective as the application and the computational resources allow. $F_{j,k}$ can be regarded to represent the best generally obtainable selectivity. It is then seen that any non-flat frequency response of the transducer, $T_j$, will distort the selectivity.

Furthermore the consequences may become even more critical if the filter banks used for analyzing the two sound pressures are subject to different distortions of the selectivity.

If a correction or equalization filter, $E_j$, is introduced into the signal path between the transducer and the filter bank, the distortion of the selectivity can be reduced or eliminated. The equalization filter should have a frequency response that approximates the reciprocal of the frequency response of the transducer:

$$E_j \approx \frac{1}{T_1}$$

and:

$$E_j T_j \approx 1$$

Introducing the equalization filter means:

$$X_j = \sum_{k=1}^{N} F_{j,k}^2 E_k^2 T_k^2 (Ps_k + Pn_k)$$

and for the spectral leakage:

$$L_j = \sum_{k=1}^{(j-1)} F_{j,k}^2 E_k^2 T_k^2 Ps_k + \sum_{k=(j+1)}^{N} F_{j,k}^2 E_k^2 T_k^2 Ps_k$$

and so:

$$L_j \approx \sum_{k=1}^{(j-1)} F_{j,k}^2 Ps_k + \sum_{k=(j+1)}^{N} F_{j,k}^2 Ps_k$$

By applying an equalization filter the filter bank selectivity can be restored and the selectivity controlled to be equal for both channels.

When measuring the physical qualities necessary for calculating the occlusion effect the microphone measures the sound pressure caused by the speech signal from the mouth of the user of the hearing aid, i.e. the air conducted speech. The microphone transforms the acoustic sound external to the user's ear into an electrical signal in the hearing aid.

From this signal the speech signal sound pressure in the open ear can be estimated by applying a frequency dependent correction. The correction may be applied in the subsequent filter block.

The sound pressure in the occluded ear canal, $p_{drum,occ}$, is sensed by the receiver, i.e. telephone or loudspeaker, of the hearing aid, when the hearing aid is operated in an occlusion measurement mode.

In the occlusion measurement mode the receiver is electrically disconnected from the output of the signal processing unit of the hearing aid, and instead connected to an input, e.g. in the form of a pre-amplifier 32 or an ND converter 34. Then it functions as a microphone sensing sound pressure in the ear canal, e.g. through the sound tube 3,19 of the hearing aid. The input to which the receiver could be connected is the input of the one of two microphones 10,11 for obtaining the directional characteristic not applied for measuring the sound pressure external to the ear. Also the input to which a telecoil is connected could be used for the receiver.

When operated in the occlusion measurement mode the detected speech level will be sampled at a given sampling rate. This sampling rate is often in the range 5-20 samples/second, preferably it is not less than 10 samples/second. When calculating the occlusion effect, the calculation must be based on sets of samples simultaneously sampled from the microphone 10 outside the ear canal and from the receiver 20 in the ear canal 4, respectively.

The electrical signal from the microphone 10 and from the receiver 20, when used as microphone in the occlusion measurement mode, is guided to pre-amplifier 31, 32. The pre-amplifier is usually designed to have an idle noise floor somewhat lower than the idle noise floor of the microphone in order to not significantly add further noise to the microphone signal. The microphone could be an electret type microphone.

The receiver used as a microphone has other properties than a typical microphone, e.g. of the electret type. Such other properties relate to the sensitivity and the idle noise of the receiver used as microphone being lower, and therefore the pre-amplifier idle noise becomes important and somewhat critical. Therefore the pre-amplifier idle noise should preferably be low.

The pre-amplified signals are directed to analogue-to-digital (ND) converters 33, 34 forming digitized electrical signals. Also the A/D converters should have idle noise floor lower than the idle noise floor of the microphone.

The two digitized electrical signals are preferably directed to filters 35, 36 applied for conditioning the signal in different ways. This could be band limiting the signal by e.g. high-pass filtering for removing low-frequency components below a frequency of interest. The filters could also be applied for correcting for an undesired frequency response of the sensing transducer. Such an undesired frequency response could originate from the acoustic coupling to the transducer or originate from the transducer element itself, such as the receiver when used as a microphone. Thus, the equalizing filter for correcting the frequency response of the receiver could preferably be placed in the filter 36.

The filter 35 in the microphone branch for measuring the $p_{ext}$ may adjust the signal from representing the sound pressure at the microphone position to representing an estimate of the sound pressure in the open ear.

The next block in FIG. 4 is the filter bank 41, 42 providing the first stage of a spectral analysis of the signal. It splits the signal into a number of frequency bands. The filter bank 41, 42 may comprise a number of band-pass filters for splitting the signal into frequency bands. The filter bank may also, or alternatively, comprise a spectral estimation algorithm, e.g. Fourier Transform, also for splitting the signal into frequency bands. The filter bank thus forms band split digitized electrical signals. If the filter bank was omitted the spectral analysis would be reduced to a simple broadband analysis.

The block following the filter bank 41, 42 in FIG. 4 is the detector bank 43, 44. The detector bank 43, 44 measures the level of the signal in each frequency band. The measure in each frequency band may be of different properties of the signal. At least the following five properties may be applied for a measure for the level of the signal in each frequency band:

1) The detector may find the RMS (root mean square) value of the signal, also known as the L2 norm of a signal.
2) The detector may find other norms of the signal such as the L1 norm ("abs-average") etc.
3) The detector may apply more or less averaging of the instantaneously detected value.
4) The detector may have asymmetric time constants for attack and release, and so estimate specific percentiles.
5) The detector may calculate the logarithm of the norm, e.g. the level in dB or other logarithmic representations.

From the detector bank the signal passes a block 45, 46 for detecting and discarding invalid data. Data contaminated with noise (such as the electrical idle noise of the input circuitry) or leakage from adjacent bands should not be used in the calculation of the occlusion effect. Noise contaminated data may be addressed by discarding detected values below a certain threshold. Also the spectral leakage of a narrowband signal from one band to the adjacent bands is a characteristic property of the filter bank. The amount of leakage depends strongly on the actual filter bank design and implementation. Leakage contaminated data may be addressed by a comparison with adjacent bands. Values so low that they are approaching the spectral leakage from an adjacent band, should be discarded.

Preferably, only the hearing aid users own voice should be applied as sound source for the occlusion measurement. Data based on other sounds may also be detected and discarded.

The two sound pressures used for calculating the occlusion effect should as mentioned be measured at the same time. When measuring the two levels repeatedly, the occlusion effect may be calculated as function of time. When the two levels are also measured in a number of frequency bands, the occlusion effect may also be calculated as function of frequency.

The ratio shall only be calculated for a time and frequency if both channels, i.e. the signal from the receiver in the occluded ear and the open ear signal measured by the microphone, have produced valid data. If the data of one channel have been discarded for some samples, then the occlusion effect is not calculated for these samples.

After the calculation of the occlusion effect in the ratio block 50, post processing of the data may be performed in the post processing and display block 55. Post processing may be applied to reduce the amount of data or emphasize certain aspects of the data for a suitable display or other means of communication—eventually other decision making or advising processes. Post processing may include time and frequency weighting and averaging. Finally, the data are displayed in a suitable form. The display would typically be on a monitor external to the hearing aid.

Figure 5:
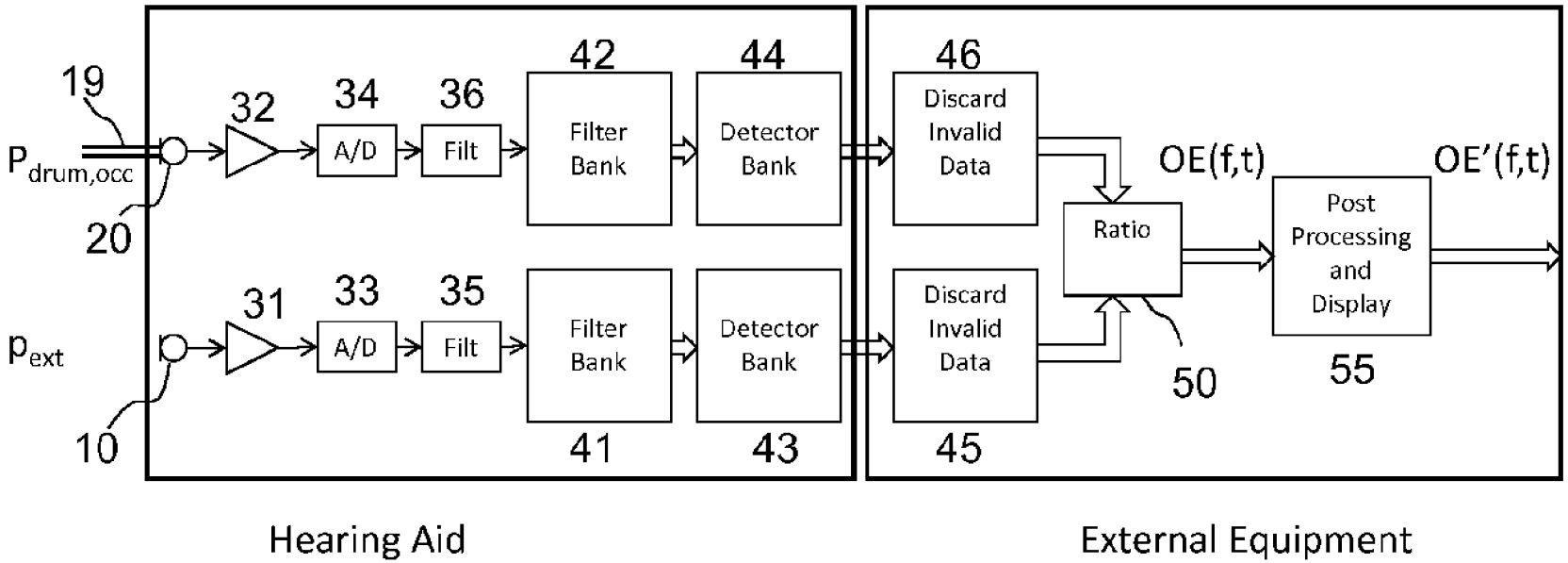
FIG. 5 illustrates an embodiment where the means for discarding invalid data, calculation of ratio and display are arranged outside the hearing aid.

FIG. 5 indicates a preferred embodiment of the setup with the hearing aid and the external equipment. At the left side the transducers sensing the sound pressures are located in the hearing aid. Also the filter bank and the detector bank of the hearing aid are applied for both channels. To the right side the detection of invalid data and the occlusion effect calculation as well as the display and communication of the final result is handled by external equipment. The hearing aid will process the signal through two available 15 band filter banks to the percentile detectors, e.g. based on the "abs-average" (L1 norm), and provides estimated logarithmic percentiles. These percentiles are transmitted to the external equipment, usually a computer, where data is sorted and the occlusion effect is calculated and displayed.

Other embodiments of how the system may be distributed between the hearing aid and some external equipment are possible within the frame of the invention. Exact where to split the system may depend on the specific resources available. If the hearing aid can transmit (stream) the captured audio signals to the external device, the remaining processing can take place there. The external equipment may provide more computing power and greater flexibility in programming the analysis, compared to the hearing aid.

Figure 6:
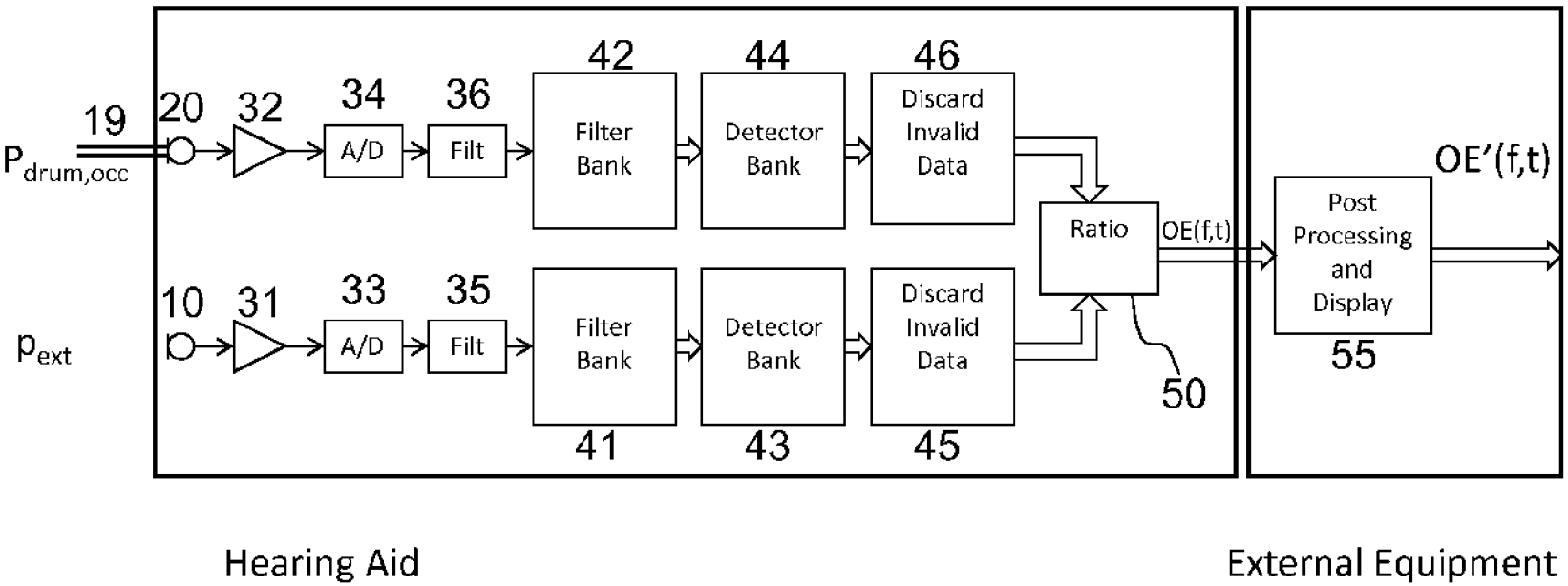
FIG. 6 illustrates an embodiment where the means for detecting and discarding invalid data and the ratio calculation means are arranged in the hearing aid.

FIG. 6 shows another embodiment of the setup with the hearing aid and the external equipment. At the left side the transducers sensing the sound pressures are located in the hearing aid as well as the filter bank and the detector bank of the hearing aid, and the detection of invalid data and the occlusion effect calculation are performed in the hearing aid for both channels. To the right side the communication, in the form of post processing and display 55 of the final result, is handled by external equipment. This setup depends on the hearing aid having sufficient processing power and flexibility for doing the complete calculation of the OE. Only the final result needs to be transmitted from the hearing aid to external equipment for display etc.

Figure 7:
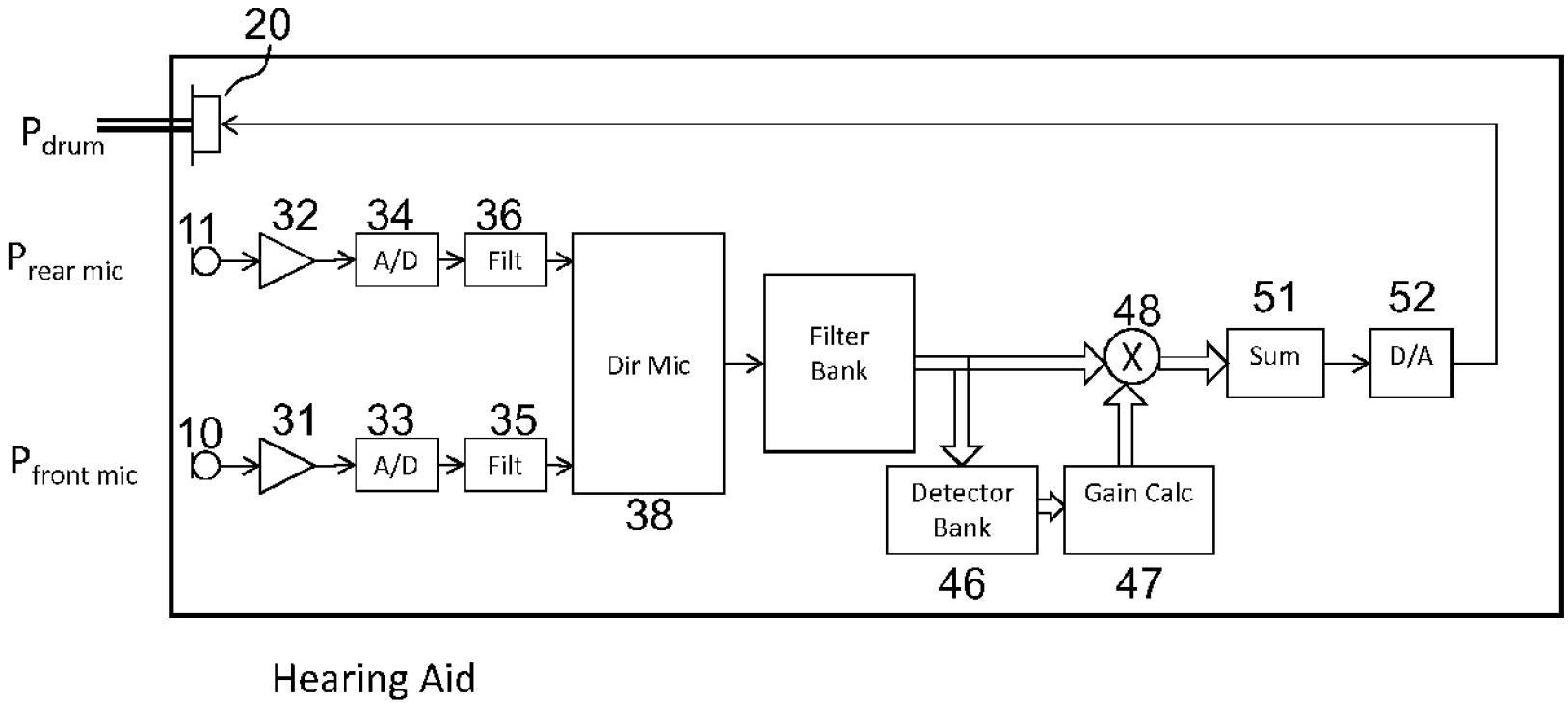
FIG. 7 illustrates a possible layout of a hearing aid into which the invention could be implemented.

FIG. 7 shows a standard simplified and generic scheme for a hearing aid into which the invention could be implemented in an embodiment. The setup of the hearing aid shown in FIG. 7 could also be the equivalent to an embodiment of the hearing aid of the invention when in sound amplification mode. The hearing aid comprises two microphones for measuring the acoustic sound level external to the ear canal of the hearing aid user. The difference between the signals from these two microphones may be applied in the "Dir Mic" box 38 for achieving some directional characteristic. The filterbank will separate the signal in a number of frequency bands, the level of each being detected in the detector bank 46 before calculating the gain 47 or compressor level for the amplification 48 of each frequency band. The frequency bands are summed 51 into one signal before the digital to analogue converter 52. For the purpose of the present invention only the signal from one of these two directional microphones 10, 11 is necessary.

Figure 8:
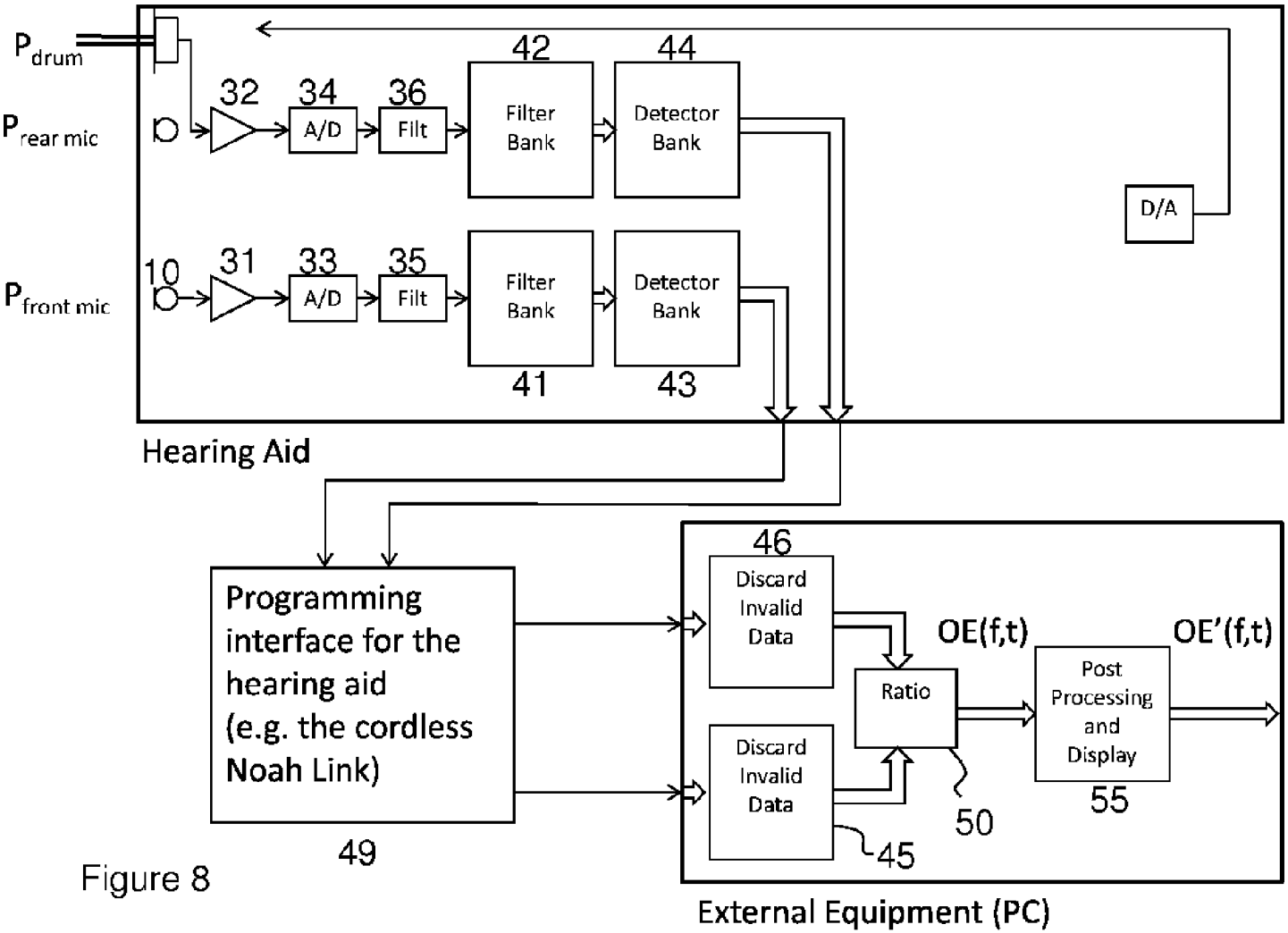
FIG. 8 illustrates the hearing aid of FIG. 7 arranged for an embodiment of a hearing aid according to the invention operating in an occlusion measurement mode.

FIG. 8 shows how the resources of the hearing aid of FIG. 7 may be reconfigured for the occlusion measurement mode of a hearing aid according to an embodiment of the invention. As seen the receiver is disconnected from the D/A output 52 and connected to one of the microphone input amplifiers instead of one of the microphones. The output of the detector banks is transmitted through the hearing aid programming interface 49 to a computer. Sorting of data, calculation of occlusion effect and displaying of the results is done on the computer.

Figure 9:
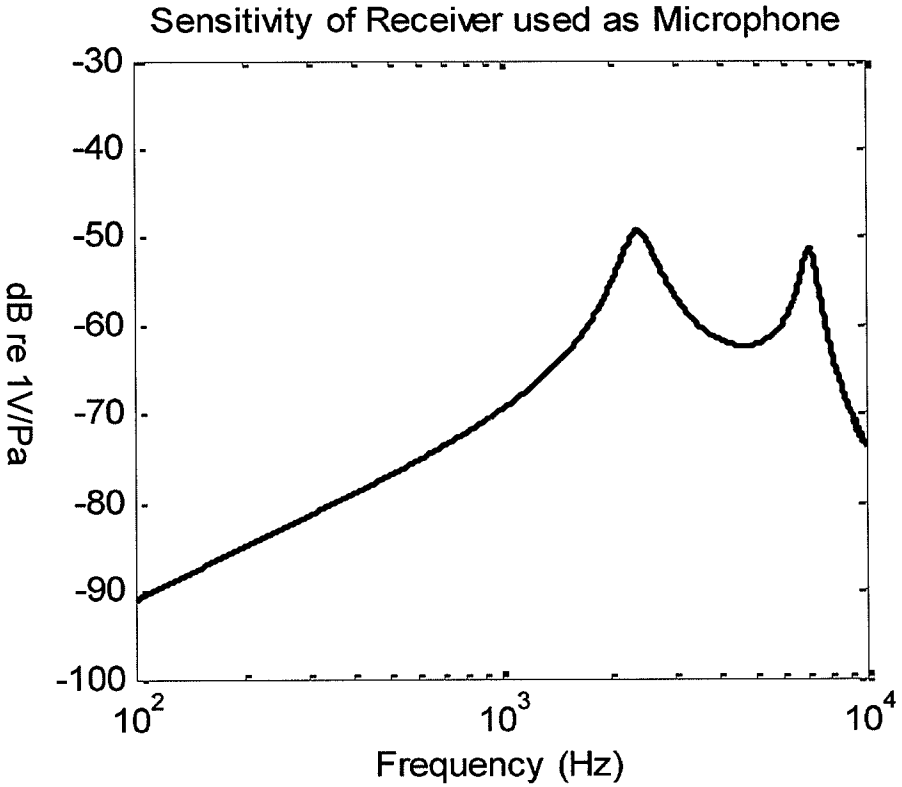
FIG. 9 illustrates a graph with the sensitivity in dependency of frequency of a typical receiver, when the receiver is used as microphone.

FIG. 9 shows a graph with the sensitivity of a typical receiver in dependency of frequency, when the receiver is used as microphone. The standard receiver used as microphone is approximately 55 dB less sensitive than a standard microphone, and a two-way receiver, is 65 dB less sensitive. The graph shows resonance frequency peaks, caused by internal resonances in the receiver.

Figure 10:
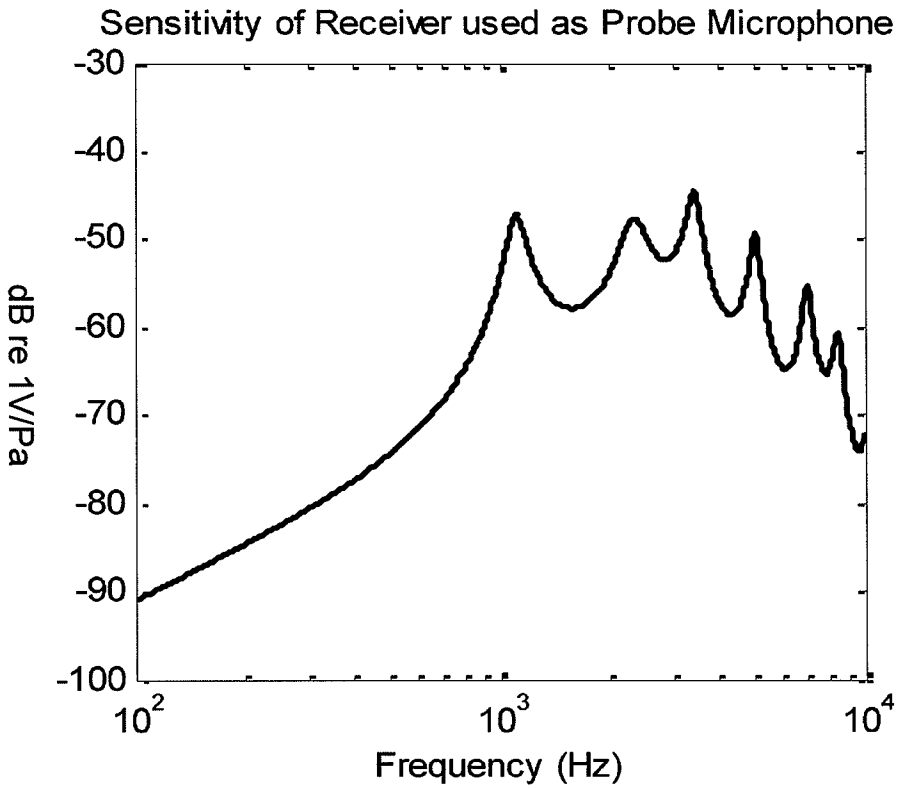
FIG. 10 illustrates a graph with the sensitivity in dependency of frequency of a typical receiver when used as probe microphone with the sound canal of a BTE as the probe tube.

FIG. 10 shows the sensitivity in dependency of frequency for a typical receiver where the receiver has been arranged with a tube 3,19 for connecting the receiver in a BTE hearing aid with the ear mould. This tube adds some further resonance peaks to the graph including the first peak between 1 and 2 kHz. The exact frequency and level of these peaks depends on the actual dimensions of the individual ear mould and tube. So they may introduce some variability at higher frequencies. If individual calibration of each hearing aid should be avoided, the frequency range for measuring the occlusion effect by application of the receiver as microphone may be limited to the range below 700 Hz, where the variation between ear moulds is small. In this frequency range the sensitivity of the receiver used as microphone is low. Therefore, the noise level in the system is important for the proper functioning of the occlusion measurement. The frequency range below 700 Hz is also the range where the occlusion effect is most significant as indicated in FIG. 3. Furthermore, the presumption that the sound pressure external to the ear is equivalent to the unoccluded sound pressure at the ear drum is also valid in this frequency range.

Figure 11:
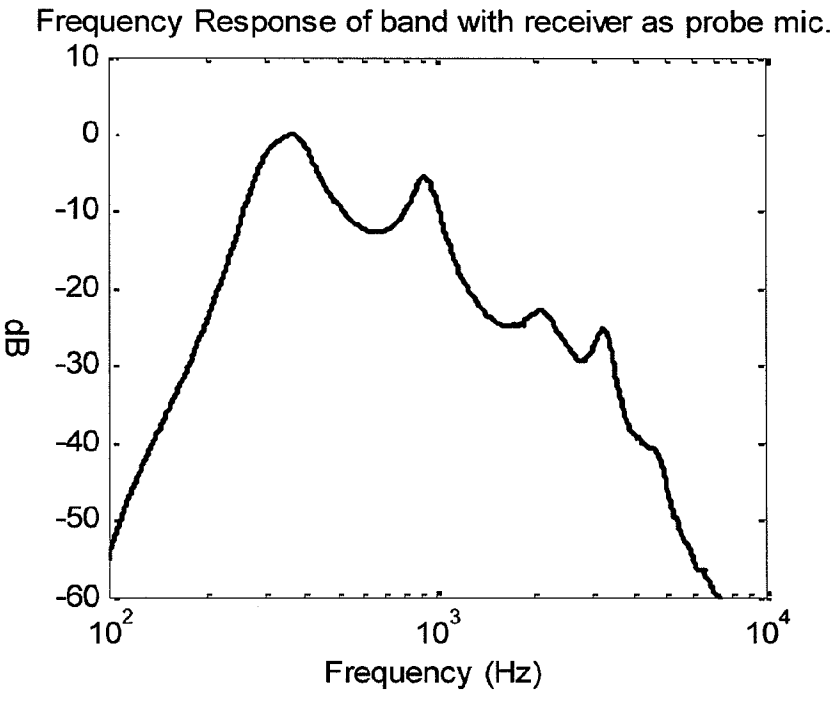
FIG. 11 is an example of the frequency response for a standard microphone channel with a band pass filter and for a receiver used as probe microphone channel with the same band pass filter (and no equalization filter to compensate for the transducer frequency response).
Figure 11:
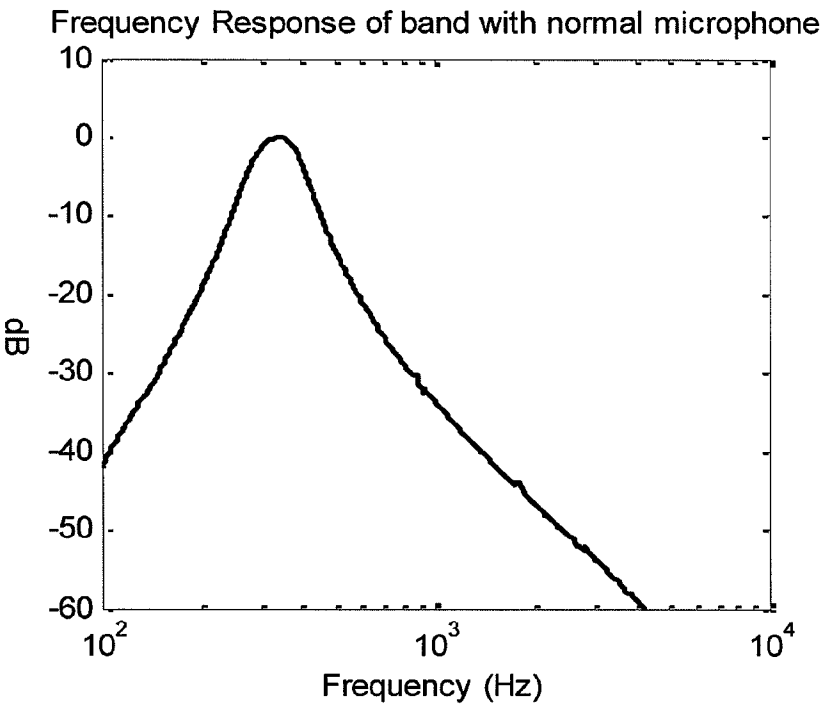

FIG. 11 is an example of the frequency response of the filter bank for a standard microphone channel and for a receiver used as microphone channel. The standard microphone response is shown at the left and the receiver response is shown at the right. It is seen that the response for each frequency band of the receiver used as microphone is broader and comprises further frequency peaks than the response of the standard microphone. Based on this it is realized that equalizing the frequency response of the receiver before the filter bank may be advantageous. After equalization the second graph should preferably be equivalent to the first graph, at least in the frequency range where occlusion is to be calculated.

Nomenclature

OE Occlusion effect $p_{drum,occluded}$ Sound pressure at ear drum with occluded ear canal $p_{drum,open}$ Sound pressure at ear drum with open ear canal $p_{ext,occluded}$ Sound pressure external to ear canal with occluded ear canal $p_{ext,occluded}$ Sound pressure external to ear canal with open ear canal $f_j$ Cross over frequency from band j−1 to band j $F_{j,k}$ Frequency response in band j to a signal in band k $T_j$ Sensitivity to sound pressure in band j
Ps Power of sound pressure signal
Pn Power of noise
$X_j$ Power of output of filter j
$s_j$ Sound pressure signal in band j
$L_j$ Spectral leakage to band j
$N_j$ Noise to band j
$E_j$ Frequency response of equalization filter

We claim:

1. A system for measuring the occlusion effect comprising a hearing aid adapted for operation in a sound amplification mode and for operation in an occlusion measurement mode, said hearing aid comprising a microphone adapted for transforming an acoustic sound level external to a hearing aid user's ear canal into a first electrical signal, said first electrical signal being guided to an A/D converter forming a first digitized electrical signal, a receiver adapted for generating acoustic sounds in the ear canal of a user when in said amplification mode, and adapted for, when in said occlusion measurement mode, transforming the acoustic sound level in the ear canal into a second electrical signal, and means for directing the second electrical signal obtained by the receiver in occlusion measurement mode to an A/D converter forming a second digitized electrical signal, said system comprising a signal processing means comprising a filter bank for splitting an electrical signal into different frequency bands, wherein said system is adapted for, when measuring the occlusion effect with said hearing aid in occlusion measurement mode, having said signal processing means apply said filter bank for splitting the first and the second digitized electrical signals into respective first and second band split digitized electrical signals, respectively, said first and second band split digital electric signals each representing the signal in a number of separate frequency bands, and wherein said hearing aid comprises means for transmitting simultaneous samples of the first and the second band split digitized electrical signals to calculating means for calculating the occlusion effect, said calculating means comprising a detector bank for measuring the level of the signal in each frequency band, and said calculation being based on a ratio between simultaneous samples of the first and the second band split digital electric signals, wherein said second electrical signal is equalized before said filter bank in order to compensate the frequency dependent transfer functions of the hearing aid receiver when used as a microphone.

2. The system according to claim 1, wherein the signal processing means including the filter bank is part of said hearing aid.

3. The system according to claim 1, wherein said filter bank comprises bandpass filters for dividing an electrical signal into bandpass filtered electrical signals.

4. The system according to claim 1, wherein said hearing aid comprising switching means for switching the receiver between sound amplification mode and occlusion measurement mode.

5. The system according to claim 1, wherein said calculating means are arranged within the hearing aid.

6. The system according to claim 5, wherein said calculating means comprises means for detecting and discarding invalid data.

7. A method for measuring the occlusion effect using the system of claim 1, comprising the steps of arranging a hearing aid at a hearing aid user's ear with the earmould or the hearing aid housing fitting tightly in the ear canal, operating the hearing aid in an occlusion measurement mode, transforming an acoustic sound external to a hearing aid user's ear into a first electrical signal by application of a microphone in the hearing aid, transforming an acoustic sound level in the hearing aid user's ear canal into a second electrical signal by application of the receiver in the hearing aid, converting said first and second electrical signals into first and second digitized electrical signals, equalizing said second digitized electrical signal in order to compensate the specific transfer function of a receiver used as microphone, said equalization being performed before the filter bank, splitting the first and the second digitized electrical signals into respective first and a second band split digitized electrical signals, said first and second band split digital electric signals each representing the signal in a number of separate frequency bands, transmitting simultaneous samples of the first and the second band split digitized electrical signals to calculating means for calculating the occlusion effect, said calculating means comprising a detector bank for measuring the level of the signal in each frequency band, and said calculation being based on a ratio between simultaneous samples of the first and the second band split digital electric signals.

8. The method according to claim 7, wherein the hearing aid user's own voice is applied as sound source during the measuring of the occlusion effect.

9. The method according to claim 8, wherein said first and second electrical signals are applied for determining if the hearing aid user's own voice is the sound source at a specific time.

10. A hearing aid adapted for operation in a sound amplification mode and for operation in an occlusion measurement mode, said hearing aid comprising a microphone adapted for transforming an acoustic sound level external to a hearing aid user's ear canal into a first electrical signal, said first electrical signal is guided to an A/D converter forming a first digitized electrical signal, a receiver adapted for generating acoustic sounds in the ear canal of a user when in said amplification mode, and adapted for, when in said occlusion measurement mode, transforming the acoustic sound level in the ear canal into a second electrical signal, and directing the second electrical signal to an A/D converter forming a second digitized electrical signal, and means for directing the second electrical signal obtained by the receiver in occlusion measurement mode to an A/D converter forming a second digitized electrical signal, and signal processing means comprising a filter bank with means for splitting an electrical signal into different frequency bands, wherein said signal processing means is adapted for, when in said occlusion measurement mode, applying said filter bank for splitting the first and the second digitized electrical signals into respective first and second band split digitized electrical signals, said first and second band split digital electrical signals each representing the signal in a number of separate frequency bands, and wherein said hearing aid comprises means for transmitting simultaneous samples of the first and the second band split digitized electrical signals to calculating means for calculating the occlusion effect, said calculating means comprising a detector bank for measuring the level of the signal in each frequency band, and said calculation being based on a ratio between simultaneous samples of the first and the second band split digital electric signals, wherein said second electrical signal is equalized before the filter bank in order to compensate the frequency dependent transfer functions of the hearing aid receiver when used as a microphone.

* * * * *